US012760949B2

(12) United States Patent
Michel et al.

(10) Patent No.: US 12,760,949 B2
(45) Date of Patent: Oct. 13, 2026

(54) METHOD, COMPUTER PROGRAM PRODUCT AND SYSTEM FOR MONITORING A HEAT PUMP

(71) Applicant: Viessmann Climate Solutions SE, Allendorf (DE)

(72) Inventors: Marie Michel, Battenberg (DE); Bernd Wenzel, Biebertal (DE); Bernd Hafner, Allendorf (DE)

(73) Assignee: Viessmann Climate Solutions SE, Allendorf (DE)

( * ) Notice: Subject to any disclaimer, the term of this patent is extended or adjusted under 35 U.S.C. 154(b) by 498 days.

(21) Appl. No.: 18/262,757

(22) PCT Filed: Feb. 28, 2022

(86) PCT No.: PCT/EP2022/054987
§ 371 (c)(1),
(2) Date: Jul. 25, 2023

(87) PCT Pub. No.: WO2022/189186
PCT Pub. Date: Sep. 15, 2022

(65) Prior Publication Data

US 2024/0410632 A1 Dec. 12, 2024

(30) Foreign Application Priority Data

Mar. 10, 2021 (DE) ..... 10 2021 105 836.8

(51) Int. Cl.
*F25B 49/02* (2006.01)

(52) U.S. Cl.
CPC ..... *F25B 49/02* (2013.01)

(58) Field of Classification Search
CPC ..... F24F 11/61; F24F 12/003; F24F 11/62; F25B 49/02
See application file for complete search history.

(56) References Cited

U.S. PATENT DOCUMENTS

| | | | | |
|---|---|---|---|---|
| 4,574,871 | A | 3/1986 | Parkinson et al. | |
| 5,174,365 | A | 12/1992 | Noguchi et al. | |
| 5,647,533 | A | 7/1997 | Schuster et al. | |
| 9,920,945 | B2 * | 3/2018 | Sato | F24F 11/61 |

(Continued)

FOREIGN PATENT DOCUMENTS

| | | | |
|---|---|---|---|
| CN | 108800441 | A | 11/2018 |
| CN | 110925950 | A | 3/2020 |

(Continued)

OTHER PUBLICATIONS

Office Action dated Mar. 27, 2025 for EPO App. Ser. No. 22 708 930.7 with English language translation.

(Continued)

*Primary Examiner* — Lam S Nguyen
(74) *Attorney, Agent, or Firm* — Henricks Slavin LLP

(57) ABSTRACT

A method, system, and computer program product for monitoring a heat pump. The method comprises the steps of providing reference data; detecting a running time of the heat pump; comparing the running time of the heat pump with the reference data; and determining a monitoring result depending on the comparison result of the running time of the heat pump with the reference data.

15 Claims, 8 Drawing Sheets

(56) References Cited

U.S. PATENT DOCUMENTS

| | | | | |
|---|---|---|---|---|
| 2007/0267508 | A1* | 11/2007 | Hoglund | F24F 11/62 236/49.1 |
| 2015/0047375 | A1 | 2/2015 | Qu et al. | |
| 2020/0033038 | A1 | 1/2020 | Popli | |

FOREIGN PATENT DOCUMENTS

| | | | |
|---|---|---|---|
| DE | 2758153 | A1 | 7/1979 |
| EP | 2682685 | A2 | 1/2014 |
| EP | 3640556 | A1 | 4/2020 |
| EP | 3608603 | B1 | 9/2020 |
| JP | 2015-012722 | A | 1/2015 |

OTHER PUBLICATIONS

International Search Report dated Jun. 7, 2022 for PCT App. Ser. No. PCT/EP2022/054987.
English language translation of Office Action dated Oct. 26, 2021 for DE App. Ser. No. 10 2021 105 836.8.

* cited by examiner

METHOD, COMPUTER PROGRAM PRODUCT AND SYSTEM FOR MONITORING A HEAT PUMP

TECHNICAL BACKGROUND

A heat pump is a machine that, with the use of technical work, receives thermal energy from a reservoir with a lower temperature and—together with the drive energy—transfers that energy as useful heat to a system to be heated having a higher temperature. This process is used for both heat generation and cooling. In the cooling process, the useful energy is the heat that is absorbed from the space to be cooled and, together with the drive energy, is dissipated to the environment as waste heat.

A refrigeration circuit of a heat pump may include an evaporator, a compressor, a condenser, and/or an expansion valve. The evaporator may be configured to change an aggregate state of a fluid in the refrigeration circuit from liquid to gaseous by adding thermal energy from a heat source or from a refrigeration circuit/primary circuit. The compressor may be configured to compress the gaseous fluid so that the pressure and a temperature of the gaseous fluid are increased. The condenser may be configured to change the physical state of the fluid from gaseous to liquid by releasing thermal energy to a secondary circuit, particularly a heating circuit, or heat sink. The expansion valve may be configured to cause expansion of the liquid fluid so that the pressure of the liquid fluid decreases. This allows a heat energy from a heat source or cooling circuit to be supplied to a heating circuit/secondary circuit or heat sink.

Since a heat pump operates independently of a fuel, user interaction with the heat pump is usually very low. As a result, monitoring of the heat pump's operation is usually neglected by the user and inefficient operation of the heat pump, i.e., with unnecessary energy consumption and/or high wear, is often not noticed. In addition, monitoring a heat pump with conventional methods is usually very complex, so that the expertise of a professional is required to monitor the heat pump.

For example, EP 3 608 603 B1 discloses a heating medium circulation system for this purpose. The heating medium circulation system comprises a heating means for heating a liquid heating medium, a pump configured to circulate the heating medium through a circulation circuit passing through an indoor heating terminal and the heating means; control means electrically connected to the heating means and the pump, the control means being configured to perform an indoor heating operation for supplying the heat medium heated by the heating means to the indoor heating terminal and a defrosting operation for causing frost adhering to the air heat exchanger to melt; and means for detecting a supply temperature that is a temperature of the heat medium supplied to the indoor heating terminal from the heating means.

The heating device comprises an air heat exchanger configured to exchange heat between a refrigerant and air; and a compressor configured to compress the refrigerant. The control means deactivates the compressor when the supply temperature exceeds a first deactivation temperature in the indoor heating operation after a predetermined period of time elapses from a switching time point from the defrosting operation to the indoor heating operation, and does not deactivate the compressor when the supply temperature exceeds the first deactivation temperature in the indoor heating operation in a post-defrosting period that is a period until the predetermined period of time elapses from the switching time point.

Based on the above, it is an object of the invention to provide a simple, efficient and cost-effective method, computer program product and system for monitoring a heat pump.

DESCRIPTION OF THE INVENTION

The invention is set out in the independent claims. The dependent patent claims relate to particular embodiments of the invention.

One aspect of the invention relates to a method for monitoring a heat pump. The method may comprise the steps of providing reference data, detecting a running time of the heat pump, comparing the running time of the heat pump with the reference data, and determining a monitoring result depending on the comparison result of the running time of the heat pump with the reference data. Providing reference data may include retrieving data from a reference heat pump, from a cloud storage, from a storage unit, or the like.

An error message may be output depending on the monitoring result. Alternatively, or in addition to outputting the error message, a control intervention in a control method of the heat pump may be performed depending on the monitoring result. Performing the control intervention may be suggested in particular in the error message and executed only after confirmation by a user or operator of the heat pump.

A control intervention includes changing or adapting a control method of the heat pump, for example by changing one or more control parameters. In particular, parameters of a heating curve may be adjusted. Further examples of a control intervention include increasing or decreasing a volume flow in a heating circuit of the heat pump. Furthermore, an output of the heat pump may be changed depending on the monitoring result. Furthermore, the control intervention may be performed by changing one or more set values, for example, a volume flow in the heating circuit and/or a temperature (e.g., supply temperature) and/or a power (e.g., heating power of the heat pump).

Detecting a running time of the heat pump may include detecting different modes of the heat pump depending on the time. Non-limiting examples of a mode include a power mode, a standby mode, a heat pump off mode, a heat generation mode, a cooling generation mode, a predetermined power mode, a predetermined power interval mode, a demand response mode, a normal mode, a heating mode, a water heating mode, or the like. In some embodiments, detecting a running time may include detecting an electrical energy consumption. The reference data may comprise running times of a reference operation, in particular from a simulation and/or from a reference heat pump. This has the advantage that the heat pump may be monitored with respect to efficiency in a particularly simple manner, since a data collection and an evaluation of the data with respect to efficiency is performed in a particularly simple and target-oriented manner.

In a particularly advantageous embodiment, providing reference data may comprise providing a minimum length of an operating interval, detecting the running time of the heat pump may comprise detecting a duration of an operating interval of the heat pump as an operating interval length, and comparing the running time of the heat pump with the reference data may comprise comparing the minimum length of the operating interval with the operating interval length. An operating interval of the heat pump may be a period of time by which the heat pump is operated with the purpose of generating heat and/or cooling. This has the advantage that short operating intervals, which are particularly inefficient, may be detected in a simple manner. Furthermore, this allows to detect errors in the operation of a heating system with a heat pump in a particularly simple way, so that the errors may be remedied and the wear of the heat pump may be reduced.

In a particularly advantageous embodiment, providing reference data may comprise providing a minimum length of an operation stoppage, detecting the running time of the heat pump may comprise detecting a duration of an operation stoppage of the heat pump as a stoppage interval length, and comparing the running time of the heat pump with the reference data may comprise comparing the minimum length of the operation stoppage with the stoppage interval length. An operation stoppage is an operation state of the heat pump in which the heat pump is not being operated to generate heat or to cool. Examples of corresponding operating states may be a standby mode and/or a switched-off heat pump. Thus, short stoppage intervals in the operation of the heat pump may be determined and, based on the determined short stoppage intervals, an error in the operation of the heat pump may be detected. Since switching from an operation stoppage of the heat pump to a load operation of the heat pump is particularly inefficient, operation stoppages of short duration are detected accordingly.

In a particularly advanced embodiment, providing reference data may comprise providing at least one of an upper threshold value and/or a lower threshold value of a ratio between the operating interval length and the stoppage interval length. Further, the method may comprise the step of determining a ratio between the operating interval length and the stoppage interval length as a running time ratio, wherein comparing the running time of the heat pump with the reference data comprises comparing the running time ratio to the upper threshold value and/or the lower threshold value.

Thus, errors in the operation of a heating system comprising the heat pump that have negative effects on the efficiency of the system may be detected. For example, it is possible to detect switch-on temperatures and switch-off temperatures of the heat pump that have been set incorrectly. Furthermore, inefficient set values of heating circuits may be detected in particular, which lead to short operating interval durations and long stoppage interval lengths. In addition, long operating intervals and short stoppage intervals may be caused by short-term overshoots of the supply temperature and/or return liquid temperature or fluctuations in the primary volume flow of the heat pump. Thus, the heat pump may be monitored particularly easily with regard to further sources of error.

In a particularly modified embodiment, the reference data may be provided depending on one or more, particularly on all, from among a group including: a device type of the heat pump, in particular air/water heat pump, ground source heat pump and water/water heat pump, or the like; a control method of the heat pump, in particular a power control of the heat pump or a constant power of the heat pump; a performance class to which the heat pump is assigned; an operating mode, in particular demand-response operation, normal operation, water heating operation, heating operation and cooling operation or the like; a climate zone in which the heat pump is installed; an age of the heat pump; an outdoor temperature; an air humidity; a time, in particular a season, a time of day, a day of the week; a wind force. Thus, the reference data may be particularly adjusted to influences affecting the operation of the heat pump and/or its running time, and the number of falsely detected errors or falsely non-detected errors may be reduced.

In a particularly reliable embodiment, the reference data is provided depending on a plurality of operating data of heat pumps and/or depending on a simulation of a heat pump system. By using a plurality of operating data of heat pumps (or additional heat pumps), practical reference data about an efficient operation of a heat pump may be collected. By means of a simulation, the reference data may be adjusted to the heat pump system comprising the heat pump. Furthermore, by means of the simulation(s), reference data may be generated for heat pump systems for which no data are available from current practice.

In a particularly reliable embodiment, detecting a running time of the heat pump may comprise detecting the duration of a plurality of operating intervals. In addition, the method is comprising the step of determining an operating interval length depending on the duration of the plurality of operating intervals. Thus, the meaningfulness of the comparison may be improved, since short-term fluctuations in the operation in the plurality of operating intervals may be filtered out, so that the actual efficiency of the heat pump is distorted as little as possible by these fluctuations.

In another particularly reliable embodiment, detecting a running time of the heat pump may comprise detecting the duration of a plurality of operation stoppages. Furthermore, the method may comprise the step of determining a stoppage interval length depending on the duration of the plurality of operation stoppages. Therefore, the meaningfulness of the comparison may be improved, since short-term fluctuations in operation may be filtered out by the plurality of operation stoppages, so that the actual efficiency of the heat pump is distorted as little as possible by these fluctuations. This in turn may improve the result of the monitoring.

In a particularly accurate embodiment, detecting a running time of the heat pump may comprise detecting the duration of a plurality of operating intervals as a plurality of operating interval lengths, comparing the running time of the heat pump with the reference data may comprise comparing the minimum length of the operating interval with the plurality of operating interval lengths, and determining a monitoring result depending on the results of the comparisons of the minimum length of the operating interval with the plurality of operating interval lengths. Thus, it is possible to ensure that a duration of an operating interval of the heat pump, which may indicate a safety risk of the heat pump, for example, is used to determine the monitoring result.

In a particularly thorough embodiment, detecting a running time of the heat pump may comprise detecting the duration of a plurality of operation stoppages as the plurality of stoppage interval lengths, wherein comparing the running time of the heat pump with the reference data comprises comparing the minimum length of the operation stoppage to the plurality of stoppage interval lengths, and determining a monitoring result depending on the results of the comparisons of the minimum length of the operation stoppage with the plurality of stoppage interval lengths. Thus, it is possible to ensure that a duration of an operation stoppage of the heat pump, which may indicate a safety risk of the heat pump, for example, is used to determine the monitoring result.

In a particularly advanced embodiment, detecting a running time of the heat pump may comprise detecting a plurality of operating data each including a duration of an operating interval of the heat pump as an operating interval length and a duration of an operation stoppage of the heat pump as a stoppage interval length. Furthermore, the method may comprise the step of determining a ratio between the operating interval length and the stoppage interval length as a running time ratio for each of the plurality of operating data, wherein comparing the running time of the heat pump with the reference data comprises comparing the running time ratios to the upper threshold value and/or the lower threshold value. Advantageously, an operating interval temporally follows a stoppage interval or the stoppage interval temporally follows the operating interval, the duration/length of which is used to determine a corresponding running time ratio.

According to this embodiment, it is possible to ensure that a ratio between the operating interval length and the stoppage interval length of the heat pump, which may indicate a safety risk of the heat pump, for example, is used to determine the monitoring result.

A particularly more advanced embodiment may additionally comprise the steps of determining stochastic operating data from the plurality of operating interval lengths, from the plurality of stoppage interval lengths, and/or from the plurality of running time ratios; and determining stochastic reference data depending on the reference data when the reference data does not comprise stochastic reference data. Comparing the running time of the heat pump with the reference data may comprise comparing the stochastic operating data to the (corresponding) stochastic reference data. Therefore, a meaningful determination of the efficiency of the heat pump depending on a plurality, in particular a plurality, of recorded running times may be made in a simple manner. As a consequence, the heat pump may be monitored in a simple and target-oriented manner.

The determination of stochastic operating data and/or stochastic reference data may comprise, for example, a determination of one or more items selected from the group consisting of: a distribution function, a frequency distribution, a probability distribution, a mean value, a standard deviation, a variance.

A particularly more safety-aware embodiment may comprise the steps of providing one or more reference powers of the heat pump, in particular a maximum and/or minimum power of the heat pump; acquiring an electrical power during the duration of the operating interval of the heat pump; comparing the detected electrical power with the one or more reference powers of the heat pump. Determining the monitoring result may additionally be carried out depending on the comparison result of the detected electrical power with the one or more reference powers. Thus, wear and tear of the heat pump resulting in increased or decreased electrical power consumption may be detected and taken into account when monitoring the heat pump.

In a particularly modified embodiment, the one or more reference powers may be provided depending on one or more, particularly on all, from among a group including: a device type of the heat pump, in particular air/water heat pump, ground source heat pump and water/water heat pump, or the like; a control method of the heat pump, in particular a power control of the heat pump or a constant power of the heat pump; a performance class to which the heat pump is assigned; an operating mode, in particular demand-response operation, normal operation, water heating operation, heating operation and cooling operation or the like; a climate zone in which the heat pump is installed; an age of the heat pump; an outdoor temperature; an air humidity; a time, in particular a season, a time of day, a day of the week; a wind force or the like of the heat pump. In this way, the reference data may be particularly adjusted to influences affecting the operation of the heat pump and/or its running time, and the number of falsely detected errors or falsely non-detected errors may be reduced.

In a particularly reliable embodiment, the one or more reference powers may be provided depending on a plurality of heat pump operating data and/or depending on a simulation, in particular a plurality of simulations, of a heat pump system. By using a plurality of operating data of heat pumps (additional heat pumps), practice-oriented reference performances about an efficient operation of a heat pump may be collected. Simulation data may be provided by means of a simulation of a heat pump system. The one or more reference performances may be adjusted to the heat pump system comprising the heat pump depending on the simulation data. Furthermore, the simulation(s) may be used to generate reference powers for heat pump systems for which no data are available from the field.

A particularly advantageous method may comprise the step of outputting an error message depending on the monitoring result, and optionally depending on one or more comparison results. Thus, an error in the operation of the heat pump may be indicated in a particularly target-oriented manner. If the error message is output depending on one or more comparison results, an experienced person/user may also be given assistance in eliminating the error.

In a particularly maintenance-friendly method, outputting an error message may additionally be carried out depending on a result of one or more of the following comparisons: a predetermined return liquid temperature with a detected return liquid temperature of the heat pump; a predetermined supply temperature with a detected supply temperature of the heat pump; a first predetermined reference value with a difference between the detected return liquid temperature and the detected supply temperature; a second predetermined reference value with a detected primary volume flow; a third predetermined reference value with a detected pressure in the heat pump system; a fourth predetermined reference value with a detected primary temperature; a fifth predetermined reference value with a difference between the detected inlet and outlet temperature of the primary side. For example, a primary volume flow is a volume flow in the primary circuit of the heat pump. A heat pump may regularly include a primary circuit, a refrigeration circuit, and a secondary circuit. In some embodiments, a primary circuit and/or secondary circuit may be integrated into the refrigeration circuit. A primary circuit is used to absorb heat from the environment, for example, from the air, from water, from the ground, or the like. The secondary circuit serves to deliver heat, for example, to a heating circuit, to a hot water circuit, to a heat sink, or the like.

In some embodiments, the primary circuit and/or the secondary circuit may be connected to the refrigeration circuit via a heat exchanger.

The numbering of the reference values as first, second, third, fourth, fifth is not intended to represent any order or sequence of the reference values with respect to each other, but only serves to distinguish the individual reference values from each other.

The refrigeration circuit, for example, transfers a generated heat/cold to the secondary circuit, for example, by means of a heat exchanger/refrigeration exchanger. The secondary circuit may include a flow with high temperature (heating circuit) and a return. The primary circuit may comprise a low temperature supply (cooling circuit) and a return. In some embodiments, both a secondary circuit in the form of a heating circuit and a primary circuit in the form of a cooling circuit may be connected to the cooling circuit by a heat exchanger for heat/cold transfer. A primary temperature is a temperature measured in the primary circuit. A primary volume flow is a volume flow in the primary circuit. A detected pressure in the heat pump system may be a detected pressure in the primary circuit, a detected pressure in the secondary circuit, and/or a detected pressure in the refrigeration circuit.

Advantageously, a fault in the operation or in connection with the operation of the heat pump may be determined particularly easily and thus maintenance or error rectification may be carried out in a particularly efficient and target-oriented manner.

In some embodiments, running times and/or detected electrical powers of a first time interval may be compared with running times and/or detected electrical powers of a second time interval, in particular a plurality of second time intervals, for example by comparing operating interval lengths, stoppage interval lengths, running time ratios, detected powers, etc. This may have the advantage that a drop in efficiency may be detected particularly easily.

One aspect of the invention relates to a system for monitoring a heat pump. The system may comprise a reference data providing unit configured to provide reference data; a detection unit configured to detect a running time of the heat pump; a comparison unit configured to compare the running time of the heat pump with the reference data; and a monitoring result determination unit configured to determine a monitoring result depending on the comparison result of the running time of the heat pump with the reference data.

A running time may include data on an operation of the heat pump depending on time. In particular, the running time, may comprise data about a duration of an operating interval and/or a stoppage interval length, for example depending on time. The detection unit may comprise a memory unit in which corresponding data is stored. In some embodiments, the detection unit may comprise one/or more sensors. In some embodiments, the detection unit may comprise a communication unit for receiving and/or retrieving data, in particular a running time, for example from a sensor, a storage unit, a cloud storage, or the like.

In some embodiments, the reference data providing unit may comprise a memory in which reference data is stored. In some embodiments, the reference data providing unit may comprise a communication unit configured to receive and/or retrieve reference data, for example from a storage unit, a cloud storage, a simulation unit configured to perform a simulation depending on provided data, another heat pump, etc. In some embodiments, a communication unit and/or a storage unit may be equally used by the detection unit and the reference data providing unit.

In some embodiments, the reference data may comprise data relating to a reference running time, in particular a reference operating time, a reference interval length, or the like.

A particularly advanced system may comprise an output unit configured to output an error message depending on the monitoring result and optionally depending on one or more comparison results. For example, the output unit may be configured to output the error message acoustically, in particular by means of a loudspeaker, and/or visually, in particular by means of a display unit. In some embodiments, the output unit may be configured to send a message to an external device by means of a communication unit. An external device may be, for example, a PC, a cell phone, a server, or the like.

The output unit may be configured to output a signal for performing a control intervention in a control method of the heat pump depending on the monitoring result.

In some embodiments, the message may be an SMS, an email, a message in a markup language, etc. In some embodiments, a message may be sent, in particular depending on a monitoring result and/or one or more comparison results, to a professional (service installer), to a user, to a maintenance service, to a heat pump operator, and/or to a manufacturer, etc. In the following, this list is described by the terms "user or operator of the heat pump". In this way, a heat pump may be operated in a particularly goal-oriented manner with respect to safety and efficiency. In some embodiments, a message may be sent to an external device depending on a monitoring result and/or one or more comparison results.

In particular, the message may comprise an error message. Further, the message may include a suggestion for performing the control intervention. A user or operator of the heat pump may initiate performing the proposed control intervention by inputting a confirmation.

Another aspect of the invention relates to a computer program product comprising instructions which when the program is executed by a computer, cause the computer to perform the steps of the method according to any one of claims 1 to 15. Therefore, existing systems may be easily equipped with the method according to the invention and the efficiency and safety of an already installed heat pump may be improved and error of the already installed heat pump may be avoided.

DESCRIPTION OF THE FIGURES

FIG. 1 schematically illustrates a method for monitoring a heat pump according to one embodiment of the invention. The method may comprise a step S10 of providing reference data. Providing reference data may comprise providing a reference running time for the heat pump. A reference running time may include a minimum length of an operating interval of the heat pump and/or a minimum length of an operation stoppage. In some embodiments, providing reference data may include at least one of an upper threshold value and a lower threshold value of a ratio between the operating interval length and the stoppage interval length of the heat pump. In some embodiments, providing reference data may comprise retrieving and/or storing reference data from and/or in a storage unit. In some embodiments, providing reference data may include initializing a variable or a constant in a computer program product.

The method comprises step S11 detecting a running time of the heat pump. Detecting a running time may include detecting a duration of an operating interval of the heat pump as an operating interval length and/or detecting a duration of an operation stoppage of the heat pump as a stoppage interval length. An operating interval length reflects the duration of an operating interval of the heat pump in a load operation. A load operation is preferably an operation in which the heat pump is operated with the aim of generating heat or cooling. An operation stoppage may be, for example, in a standby mode or when the heat pump is switched off, or the like. In some embodiments, during an operation stoppage, the heat pump is not operated with the objective of generating heat and/or cooling.

In a step S12, the detected running time of the heat pump is compared with the reference data. The comparison may comprise, for example, a qualitative and/or quantitative comparison. In some embodiments, the result of the comparison may be an absolute result or a relative result.

In a step S13, a monitoring result is determined depending on the comparison result of the running time of the heat pump with the reference data.

In some embodiments, the method may comprise an optional step S14 outputting an error message depending on the monitoring result. In some embodiments, the error message may include an error code depending on the monitoring result. In some embodiments, the error message, in particular an error code, may additionally be output depending on one or more comparison results. In some embodiments, a unit for outputting the error message, in particular a display unit, a speaker unit, and/or a communication unit, may be selected depending on an error code and/or one or more comparison results.

In some embodiments, the method may comprise an optional step S15 determining a ratio between the operating interval length and the stoppage interval length as a running time ratio, in which case comparing the running time of the heat pump with the reference data comprises comparing the running time ratio with the upper threshold value and/or the lower threshold value.

Figure 1:
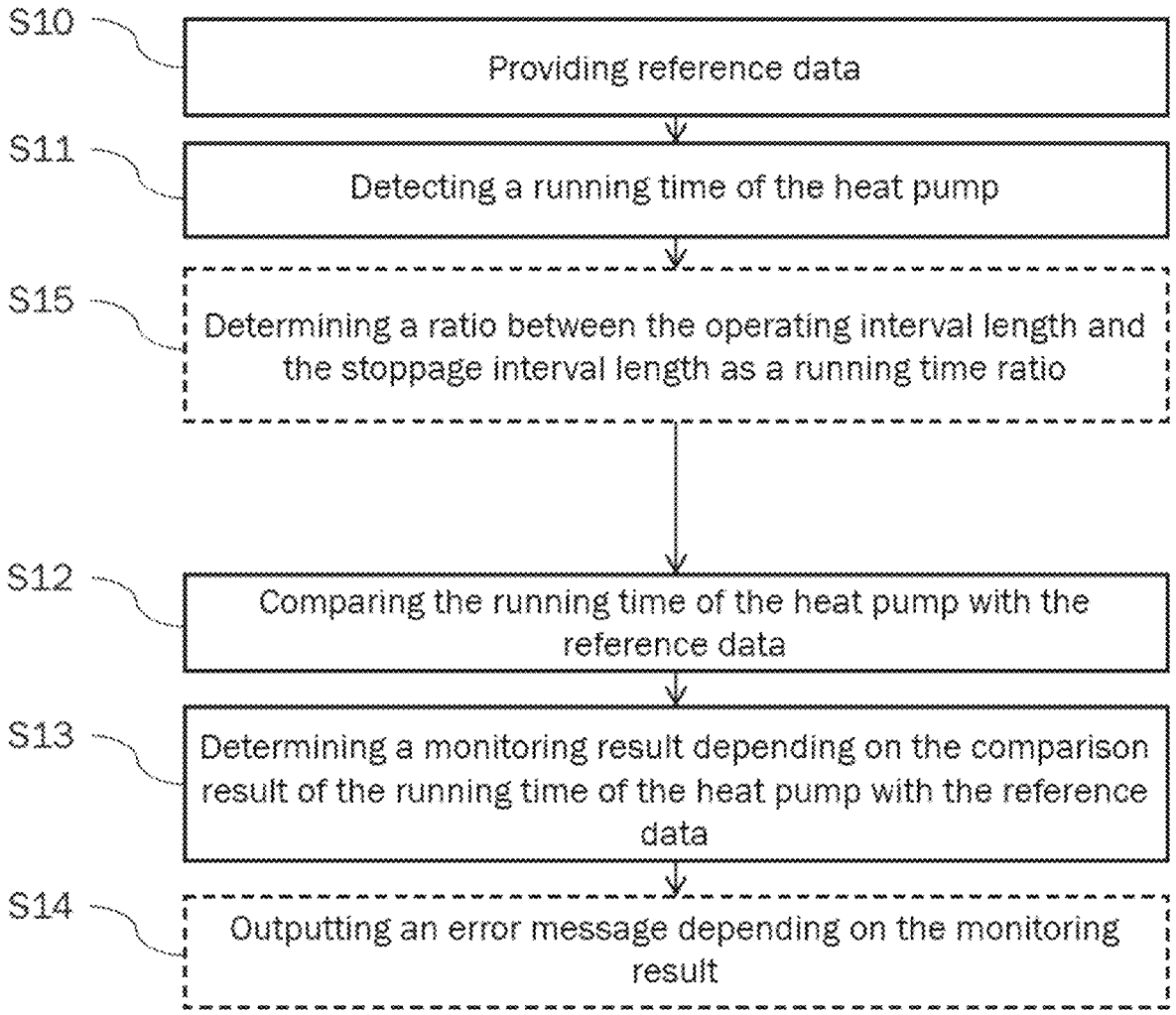
FIGS. 1, 2 and 3 each schematically illustrate a method for monitoring a heat pump according to one embodiment of the invention.
Figure 2:
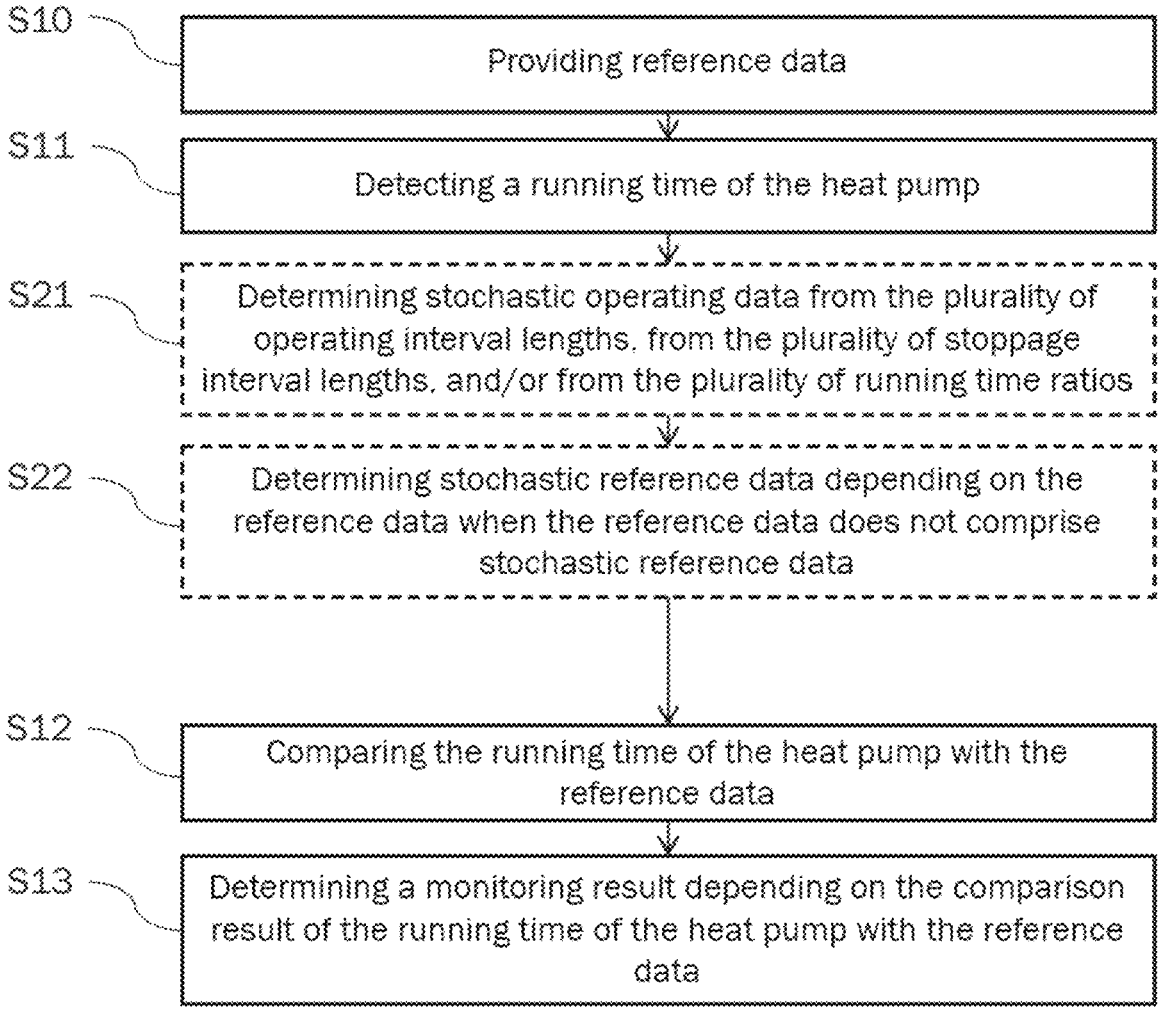

FIG. 2 schematically illustrates a method for monitoring a heat pump according to one embodiment of the invention. The method illustrated in FIG. 2 is based on the method illustrated in FIG. 1. The method illustrated in FIG. 2 may comprise an optional step S21 determining stochastic operating data from the plurality of operating interval lengths, from the plurality of stoppage interval lengths, and/or from the plurality of running time ratios. Advantageously, step S21 may be performed after step S11 and before step S12. Comparing according to step S12 may comprise, as a consequence of step S21, comparing the stochastic operating data to the stochastic reference data.

In addition, the method may include a further optional step S22 determining stochastic reference data depending on the reference data in particular when the reference data does not comprise stochastic reference data or when stochastic reference data are available only for a part of the reference data. Thus, it is possible to ensure that the acquired running times may be compared with the reference data in an optimal manner. In some embodiments, especially if the reference data already reflect or comprise stochastic reference data, step S22 may be omitted.

Figure 3:
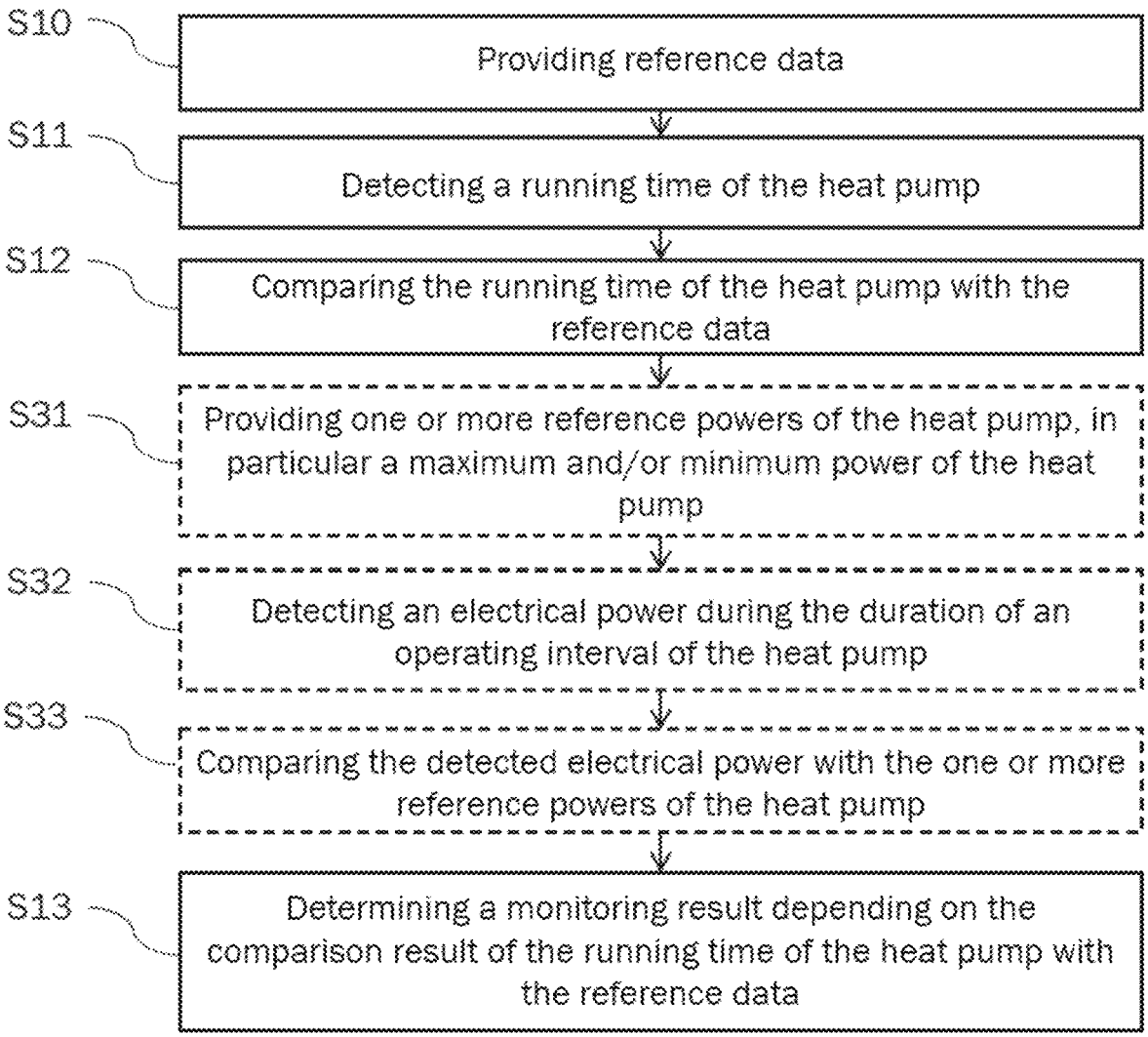

FIG. 3 schematically illustrates a method for monitoring a heat pump according to one embodiment of the invention. The method illustrated in FIG. 3 is based on the method illustrated in FIG. 1 and differs therefrom in that it optionally comprises steps S31 to S33. In the optional step S31, one or more reference powers of the heat pump, in particular a maximum and/or minimum power of the heat pump may be provided. A reference power may be provided, for example, with the aid of a simulation or with the aid of power values of another heat pump. In step S32, an electrical power is detected during the duration of an operating interval of the heat pump. In step S33, the detected electrical power is compared with the one or more reference powers of the heat pump. Determining the monitoring result in step S13 may then be performed depending on the comparison result of the electrical power with the one or more reference powers from step S32.

In some embodiments, the method steps illustrated in FIGS. 1 and 2 may be combined. In particular, steps S21, S22, S14, S15, S31 to S33 may be combined independently with steps S10 to S13 or S11 to S13. Moreover, in some embodiments, method steps may be performed in parallel, combined, divided, combined, added, or the like, without changing the core of the invention. In some embodiments, the order of the method steps may be interchanged without thereby affecting the core of the invention.

In some embodiments, a computer program product may comprise instructions that, when the program is executed by a computer, cause the computer to perform method steps of the methods illustrated in FIGS. 1 to 3.

Figure 4:
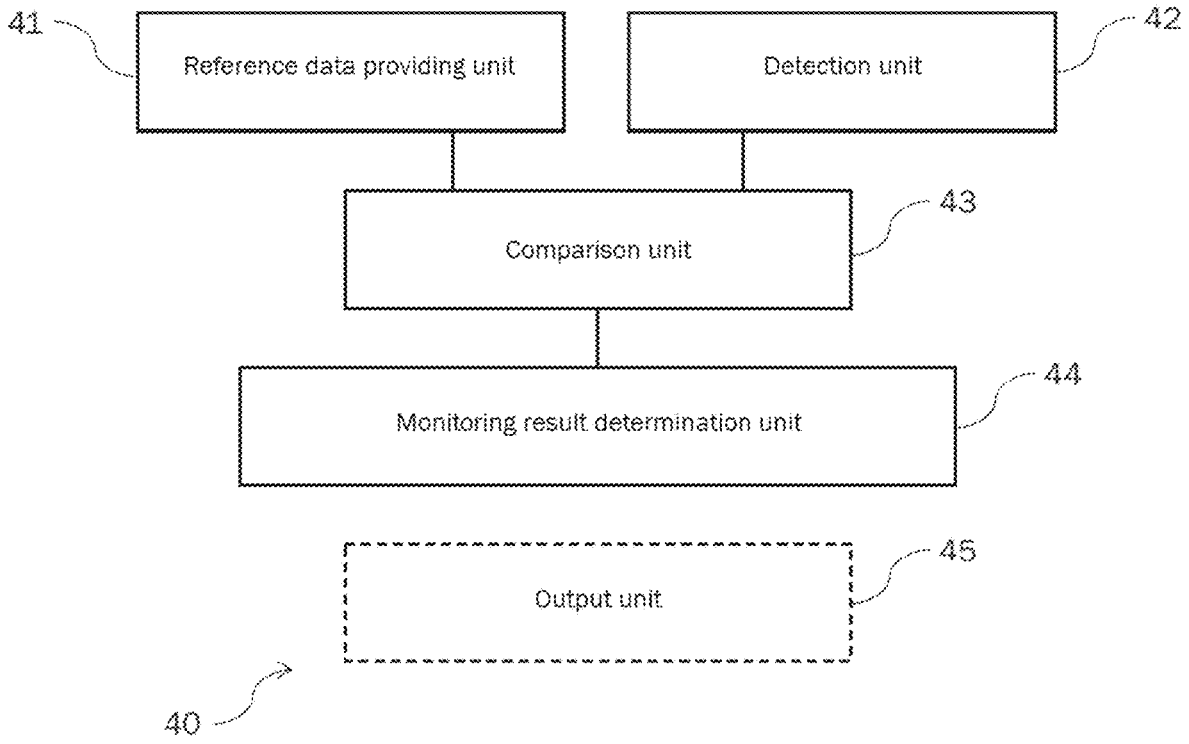
FIG. 4 schematically illustrates a system for monitoring a heat pump according to one embodiment of the invention.

FIG. 4 schematically illustrates a system for monitoring a heat pump according to one embodiment of the invention. The system 40 comprises a reference data providing unit 41, a detection unit 42, a comparison unit 43, and a monitoring result determination unit 44. In some embodiments, the system 40 may additionally comprise an output unit 45. The reference data providing unit 41 is configured to provide reference data. For this purpose, the unit 41 may comprise a storage unit in which the reference data is stored and/or a communication unit by means of which the reference data may be received or retrieved.

The detection unit 42 is configured to acquire a running time of the heat pump. For this purpose, the detection unit 42 may be connected to a control unit of the heat pump and/or to one or more sensors. In some embodiments, the detection unit 42 may comprise a communication unit configured to receive or retrieve the running time of the heat pump from the heat pump and/or a cloud storage. In some embodiments, the unit 41 and the detection unit 42 may share a communication unit and/or a storage unit. The comparison unit 43 is configured to compare the running time of the heat pump with the reference data. For this purpose, the comparison unit 43 may comprise one or more analog and/or digital circuits, in particular a computing unit.

The monitoring result determination unit 44 is configured to determine a monitoring result depending on the comparison result of the running time of the heat pump with the reference data. In some embodiments, the monitoring result determination unit 44 may be configured to additionally determine the monitoring result depending on one or more further comparison results. The monitoring result determination unit 44 may comprise one or more analog and/or digital circuits, in particular a computing unit. In some embodiments, the units 43 and 44 may share a computing unit.

The output unit 45 is configured to output an error message depending on the monitoring result, and optionally depending on one or more comparison results. In some embodiments, the output unit 15 may be configured to output an error message visually, for example by means of a display, and/or acoustically, in particular by means of a loudspeaker, optionally depending on the monitoring result and/or one or more comparison results. In some embodiments, the output unit may comprise a communication unit configured to transmit an error message to an external unit, in particular depending on the monitoring result and/or one or more comparison results. An external unit may be, for example, a mobile device, a server, a maintenance device, or the like.

The output unit 45 may further be configured to output a signal that causes a control intervention. In particular, the control intervention may be performed after confirmation by a user or operator of the heat pump. For example, the control intervention may be proposed in the error message that is output.

According to an exemplary embodiment, a long running time of the heat pump with short operation stoppages may be detected. As a result, exceeding the maximum return liquid temperature may be detected. In an error message, the user or operator of the heat pump may receive an indication that the maximum return liquid temperature has been exceeded. A possible control intervention includes, for example, increasing the volume flow by appropriately controlling a circulation pump in the heating circuit and/or reducing the power of the heat pump. The control intervention proposed or performed may also depend, among other things, on whether the heat pump is operated in heating mode or for hot water production.

In some embodiments, the output unit may share a communication unit with the unit 41 and/or 42. In some embodiments, the output unit may be configured to output an error code depending on the monitoring result and, optionally, depending on one or more comparison results in the course of outputting the error message. An error code may be a code word representing a predetermined error/specified type of error. In some embodiments, an error code may also include a description of the error.

In some embodiments, units of the system 40 may be separated, combined, or the like without affecting the core of the invention. Further, in some embodiments, additional units may be added without affecting the core of the invention.

Figure 5:
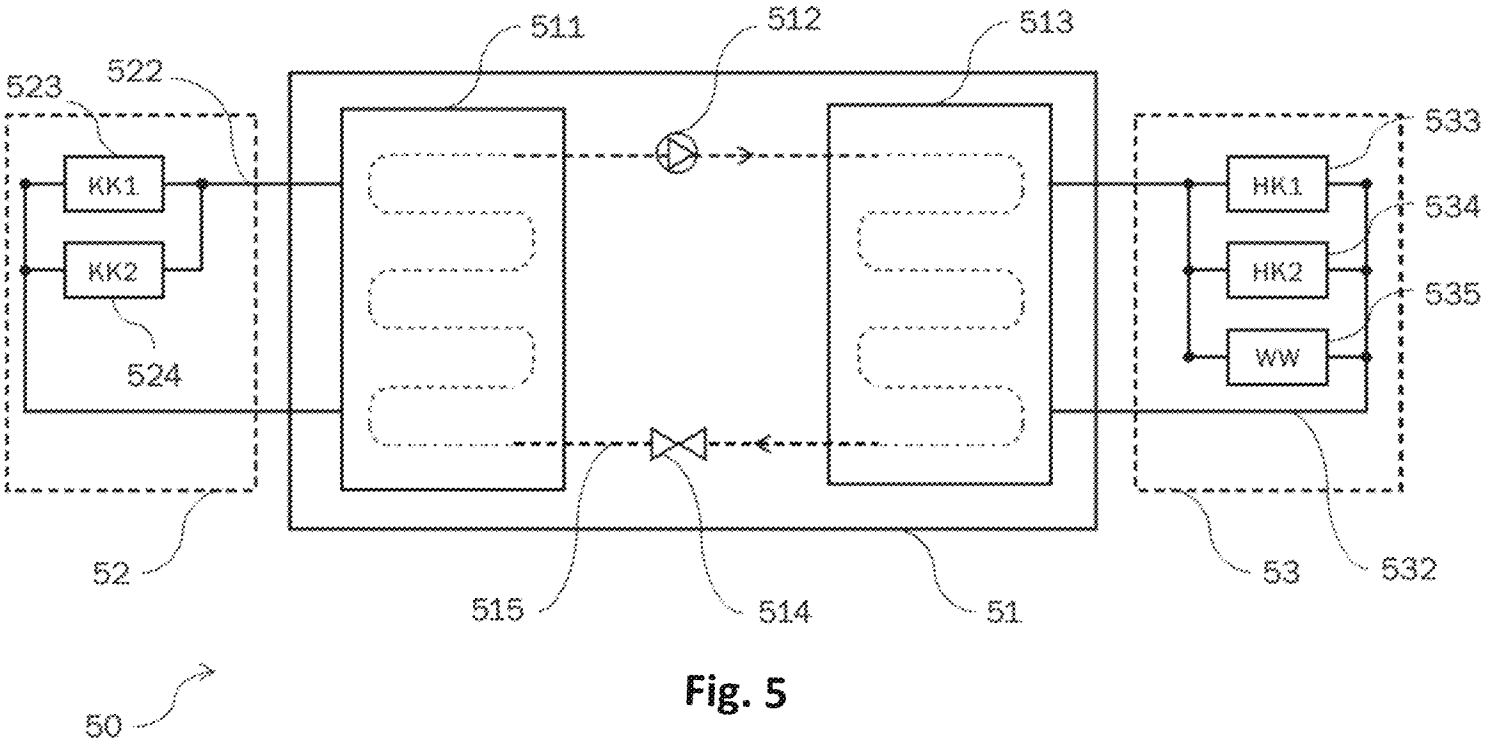
FIG. 5 schematically illustrates a heat pump system according to one embodiment of the invention.

FIG. 5 schematically illustrates a heat pump system according to one embodiment of the invention. In the heat pump system 50, a heat pump 51, a cooling side 52 and a heating side 53 are illustrated. The heat pump 51 illustrated in FIG. 5 includes a compressor 512, a liquefier/condenser 513, an expansion valve 514, and an evaporator 511, which are interconnected in a refrigeration circuit 515. In some embodiments, the heat pump may differ from the heat pump illustrated in FIG. 5 without changing the core of the invention. The evaporator 511 may further function as a heat exchanger, a heat exchanger between the refrigeration circuit 515 and the cooling side 52. In some embodiments, the cooling side 52 may be a simple heat source, such as an ambient air, geothermal, water/ice storage, or the like. In some embodiments, the cooling side 52 may include one or more cooling circuits 523, 524. In some embodiments, the cooling side 52 may form a primary circuit 522. In some embodiments, the cooling side 52 may be integrated with the refrigeration circuit 515.

In some embodiments, the heat side 53 may form a secondary circuit 532 (heating circuit and/or hot water circuit). The liquefier/condenser 513 may act as a heat exchanger for transferring heat from the refrigeration circuit 515 to the heat side 53. For example, one or more heating circuits 533, 534 and/or hot water circuits 535 may be disposed on the heat side 53. In some embodiments, the heat side 53 may include a heat sink in addition to or instead of the heating circuits. In some embodiments, the heat side 53 may be integrated with the refrigeration circuit.

The heat pump system illustrated in FIG. 5 is provided for illustration and basic understanding of a heat pump only, and is in no way intended to limit the scope of the invention. Furthermore, individual sections of the heat pump 51 as well as on the cooling side 52 as well as on the heating side 53 may be designed otherwise without limiting the functionality of the invention in any way.

Figure 6A:
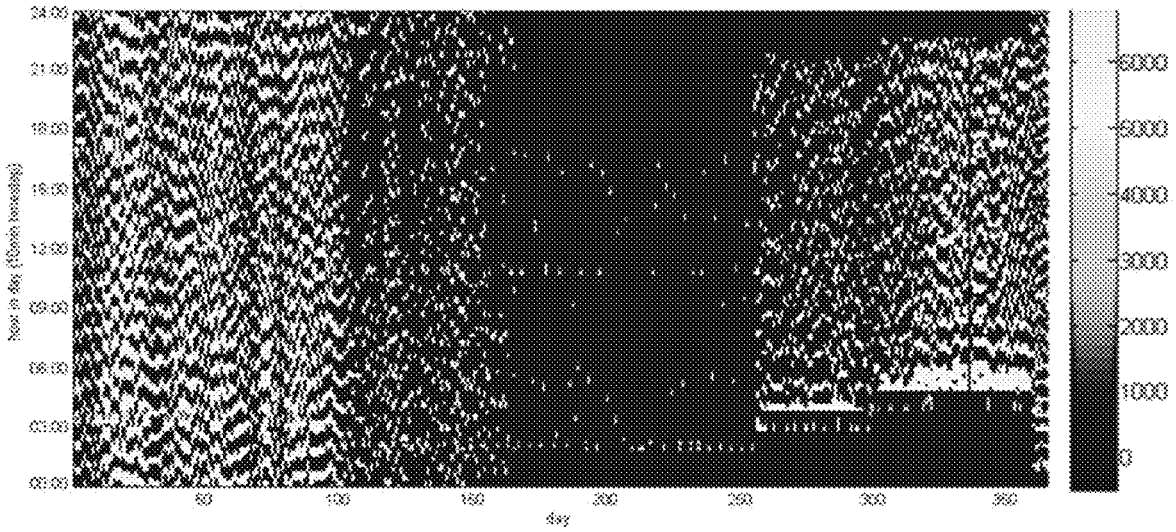
FIG. 6*a* illustrates a performance diagram depending on time of an inefficient heat pump and FIG. 6*b* illustrates a frequency distribution of the running time of this heat pump.
Figure 6B:
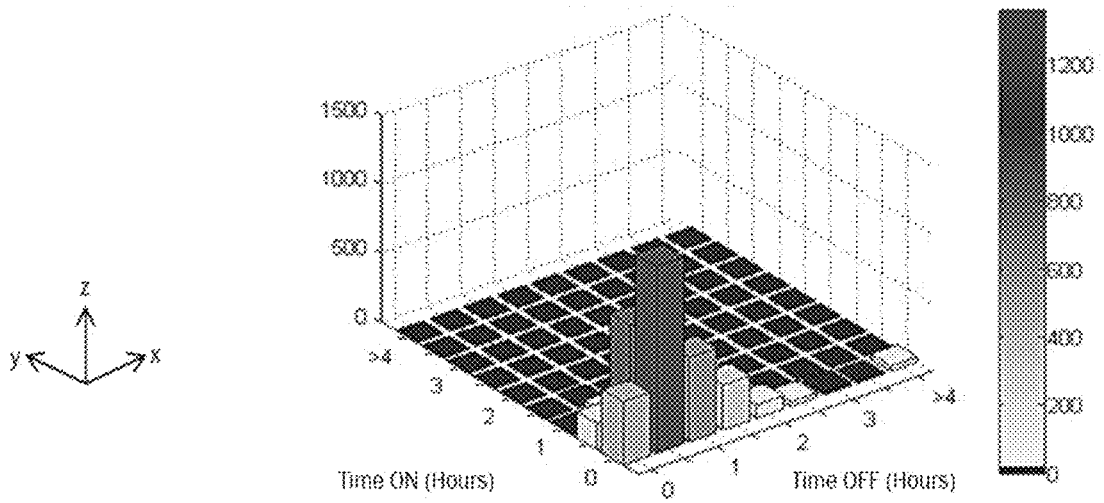
Figure 6C:
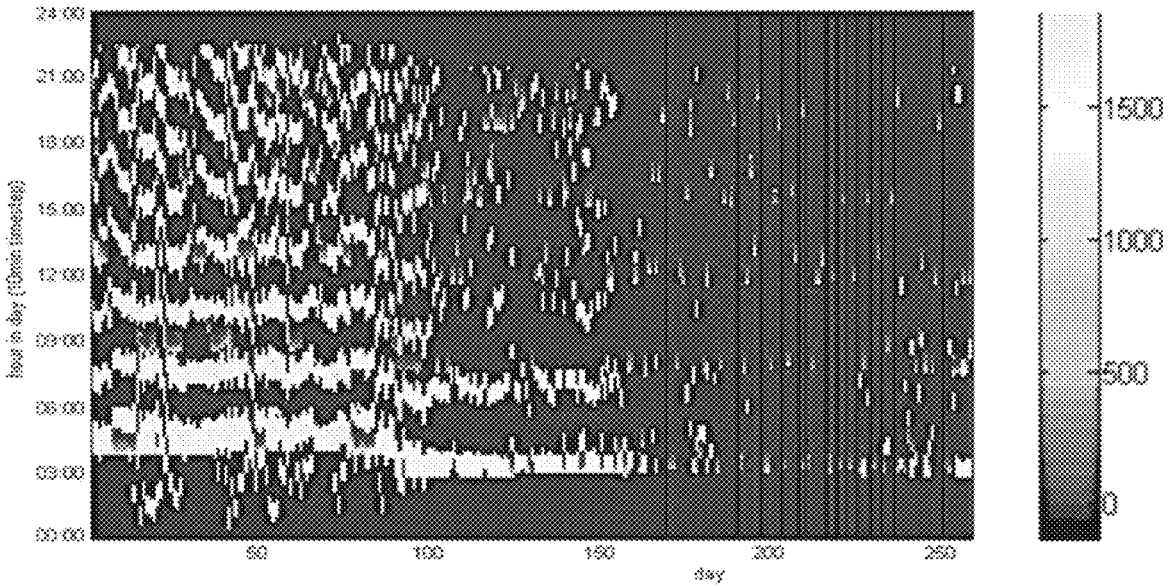
FIG. 6*c* illustrates a performance diagram depending on time of an efficient heat pump and FIG. 6*d* illustrates a frequency distribution of the running time of this heat pump.
Figure 6D:
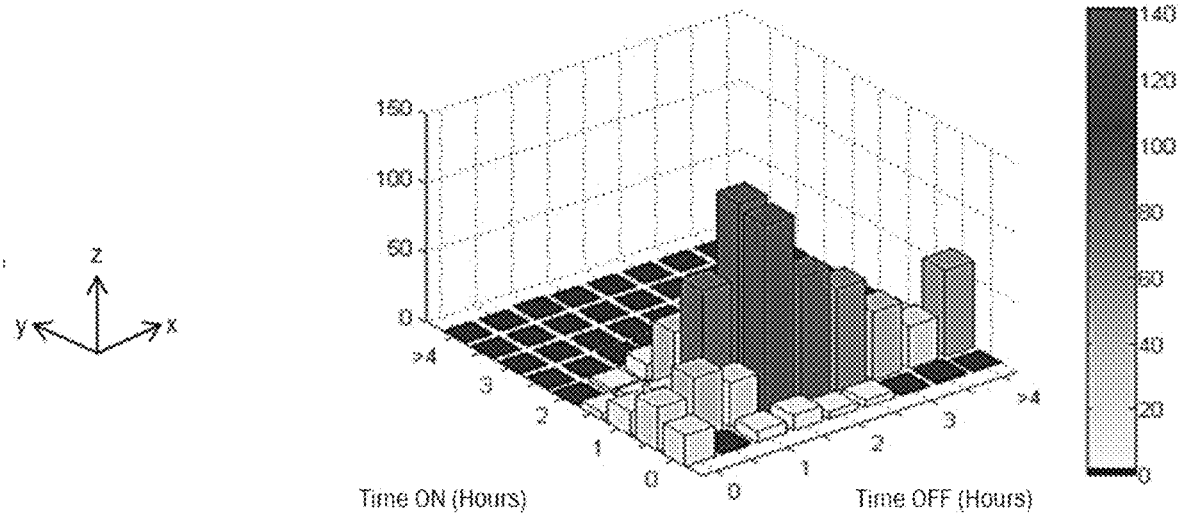

FIG. 6*a* illustrates a performance diagram depending on time of an inefficient heat pump and FIG. 6*b* illustrates a frequency distribution of the running time of this heat pump. FIG. 6*c* illustrates a performance diagram depending on time of an efficient heat pump and FIG. 6*d* illustrates a frequency distribution of the running time of this heat pump. In the diagrams of FIGS. 6*a* and 6*c*, the days of a year are plotted on the x-axis and the time of a day is plotted on the y-axis. The scale resolution with respect to the y-axis is 10 minutes. On the right hand side of FIGS. 6*a* and 6*c*, a color scheme is illustrated as a legend.

The color scheme represents a consumed electrical power in watts of the heat pump.

In the diagrams of FIGS. 6*b* and 6*d*, the stoppage interval length in hours is plotted on the x-axis, the operating interval length in hours is plotted on the y-axis, and the number of events is plotted in the z-direction. The data of the diagram of FIG. 6*b* are taken from the diagram of FIG. 6*a* and the data of the diagram of FIG. 6*c* are taken from the diagram of FIG. 6*d*.

From the diagram of FIG. 6*a*, it follows that the inefficient heat pump is operated very frequently for relatively short periods of time, i.e., shorter than 40 minutes, at a very high power, i.e., more than 4000 watts. Stoppage intervals are also usually very short, especially at the beginning and end of the year. This is particularly evident from the diagram in FIG. 6*b*. Thus, most of the events of the inefficient heat pump accumulate in the front corner, i.e., the heat pump is operated with particularly short operating intervals and particularly short stoppage intervals.

In contrast, it follows from the diagram of FIG. 6*c* that an operating interval length is mostly between one and three hours and the stoppage interval length is mostly between one and three hours. This is illustrated in particular by the diagram in FIG. 6*d*. It is evident from FIG. 6*d* that the events of the efficient heat pump are concentrated around an operating interval length of 1.5 hours and a stoppage interval length of 1.5 hours. In addition, it is possible to see from FIG. 6*d* that the efficient heat pump is operated at much lower power. In most cases, the efficient heat pump is operated with a power of between 500 and 1500 watts.

Since the wear of a heat pump is lower at a lower heating temperature and also the efficiency of the heat pump is higher at lower heating temperatures, the heat pump with the diagrams illustrated in FIGS. 6*c* and 6*d* is more efficient than the heat pump with the diagrams illustrated in FIGS. 6*a* and 6*b*.

As evident in the diagram of FIG. 6*d*, events with operating interval lengths of less than 30 minutes and stoppage interval lengths of less than 30 minutes also occur with the efficient heat pump. Consequently, however, short operating interval lengths and short stoppage interval lengths cannot be completely ruled out even for a heat pump with high efficiency. To avoid false alarms when monitoring the heat pump by means of the running time monitoring and/or performance monitoring, it may therefore be helpful to determine stochastic parameters, in particular a distribution function, a probability distribution, a mean value, a standard deviation, a variance, or the like, depending on the detected running time, and to monitor the heat pump by means of the stochastic parameters.

In some embodiments, a cumulative frequency for a predetermined range of a distribution function, in particular a frequency distribution/probability distribution, may be determined and compared to a reference value.

Figure 7:
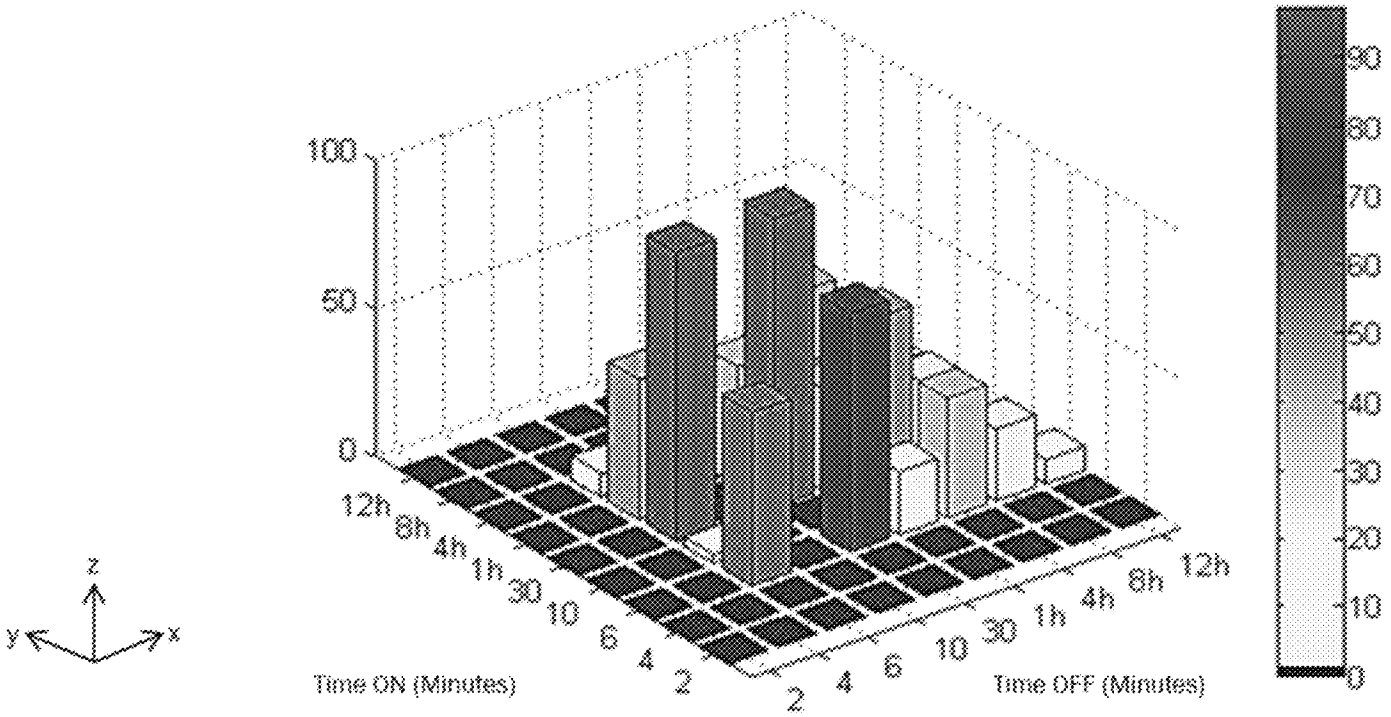
FIG. 7 schematically illustrates a frequency distribution of the stoppage interval lengths and operating interval lengths of an optimized heat pump according to one embodiment of the invention.

FIG. 7 schematically illustrates a diagram of a frequency distribution of the stoppage interval lengths and operating interval lengths of an optimized heat pump according to one embodiment of the invention. On the x-axis the stoppage interval length is plotted and, on the y-axis, the operating interval length is plotted. The number of events is plotted on the z-axis. It follows from FIG. 7 that an operating interval of the heat pump lasts at least five minutes. A stoppage interval of the heat pump also lasts at least five minutes. This avoids any inefficient short-time switching on or off of the heat pump, which results in high switch-on losses and high wear and tear. Furthermore, it is evident from FIG. 7 that the operating interval length is concentrated to between five minutes and 2.5 hours. The stoppage interval length is concentrated between five minutes and four hours.

Thus, the operation illustrated in FIG. 7 is particularly well-balanced with respect to running time, and efficient operation may be assumed in principle.

In some embodiments, in particular in one of the embodiments illustrated in FIGS. 1 to 7, an efficient heat pump may be assumed to be operating at between 0.05 and 3.0, in particular between 0.07 and 2.4, switch-ons per operating hour (number of operating interval starts per operating hour). An operating hour is an hour during which the heat pump is in operation. The sum of all operating hours is equal to the sum over all operating interval lengths.

In some embodiments, a heat pump that is of a "variable capacity-geothermal" type may be assumed to be an efficient heat pump at an average of between 0.05 and 0.2 switch-ons per hour of operation. In some embodiments, a heat pump that is of a "variable power-air" type may be considered to be an efficient heat pump at an average of between 0.2 and 0.6 switch-ons per hour of operation. In some embodiments, a heat pump that is of a "constant power-geothermal" type may be considered to be an efficient heat pump at an average of between 0.8 and 2.4 duty cycles per hour of operation.

The invention claimed is:

1. A method for monitoring a heat pump, comprising the steps of:

providing reference data by providing, with a reference data providing unit, a minimum length of a heat pump operating interval and a minimum length of a heat pump operation stoppage;

detecting a running time of the heat pump by detecting, with a detection unit, a duration of an operating interval of the heat pump as an operating interval length and a duration of an operation stoppage of the heat pump as a stoppage interval length;

comparing the running time of the heat pump with the reference data by comparing, with a comparison unit, the minimum length of the heat pump operating interval with the operating interval length and the minimum length of the heat pump operation stoppage with the stoppage interval length;

determining, with a monitoring result determination unit, a monitoring result depending on the comparison result of the running time of the heat pump with the reference data;

outputting, with an output unit, an error message depending on the monitoring result; and outputting, with an output unit, a signal for performing a control intervention in a control method of the heat pump depending on the monitoring result.

2. The method according to claim 1, wherein providing reference data comprises providing at least one of an upper threshold value and a lower threshold value of a ratio between the operating interval length and the stoppage interval length, wherein the method further comprises the step of:

determining a ratio between the operating interval length and the stoppage interval length as a running time ratio, wherein comparing the running time of the heat pump with the reference data comprises comparing the running time ratio with the upper threshold value and/or the lower threshold value.

3. The method according to claim 1, wherein the reference data is provided depending on one or more, particularly on all, from among a group including:

a device type of the heat pump, in particular air/water heat pump, ground source heat pump and water/water heat pump;

a control method of the heat pump, in particular a power control of the heat pump or a constant power of the heat pump;

a performance class to which the heat pump is assigned;

an operating mode, in particular demand-response operation, normal operation, water heating operation, heating operation and cooling operation;

a climate zone in which the heat pump is installed; and an age of the heat pump;

an outdoor temperature;

an air humidity;

a time, in particular a season, a time of day, a day of the week;

a wind force.

4. The method according to claim 1, wherein the reference data is provided depending on a plurality of operating data of heat pumps and depending on a simulation of a heat pump system.

5. The method according to claim 1, wherein detecting a running time of the heat pump comprises detecting the duration of a plurality of operating intervals; and the method further comprises the step of:

determining an operating interval length depending on the duration of the plurality of operating intervals.

6. The method according to claim 1, wherein detecting a running time of the heat pump comprises detecting the duration of a plurality of operation stoppages; and the method further comprises the step of determining a stoppage interval length depending on the duration of the plurality of operation stoppages.

7. The method according to claim 1, wherein detecting a running time of the heat pump comprises detecting the duration of a plurality of operating intervals as a plurality of operating interval lengths, comparing the running time of the heat pump with the reference data comprises comparing the minimum length of the operating interval with the plurality of operating interval lengths, and determining a monitoring result comprises determining a monitoring result depending on the results of the comparisons of the minimum length of the operating interval with the plurality of operating interval lengths.

8. The method according to claim 1, wherein detecting a running time of the heat pump comprises detecting the duration of a plurality of operation stoppages as the plurality of stoppage interval lengths; wherein comparing the running time of the heat pump with the reference data comprises comparing the minimum length of the operation stoppage to the plurality of stoppage interval lengths; and determining a monitoring result comprises determining a monitoring result depending on the results of the comparisons of the minimum length of the operation stoppage with the plurality of stoppage interval lengths.

9. The method according to claim 1, wherein detecting a running time of the heat pump comprises detecting a plurality of operating data each including a duration of an operating interval of the heat pump as an operating interval length and a duration of an operation stoppage of the heat pump as a stoppage interval length, wherein the method further comprises the step of:

determining a ratio between the operating interval length and the stoppage interval length as a running time ratio for each of the plurality of operating data, wherein comparing the running time of the heat pump with the reference data comprises comparing the running time ratios to the upper threshold value and/or the lower threshold value.

10. The method according to claim 1, further comprising the steps of:

determining stochastic operating data from the plurality of operating interval lengths, from the plurality of stoppage interval lengths, and/or from the plurality of running time ratios;

determining stochastic reference data depending on the reference data when the reference data does not comprise stochastic reference data; wherein comparing the running time of the heat pump with the reference data comprises comparing the stochastic operating data to the stochastic reference data.

11. The method according to claim 1, further comprising the steps of:

providing one or more reference powers of the heat pump, in particular a maximum and/or minimum power of the heat pump;

acquiring an electrical power during the duration of the operating interval of the heat pump;

comparing the detected electrical power with the one or more reference powers of the heat pump, wherein determining the monitoring result is additionally carried out depending on the comparison result of the detected electrical power with the one or more reference powers.

12. The method according to claim 1, further comprising the step of:

outputting an error message depending on one or more comparison results.

13. The method according to claim 12, wherein outputting an error message is additionally carried out depending on a result of one or more of the following comparisons:

a predetermined return liquid temperature with a detected return liquid temperature of the heat pump;

a predetermined supply temperature with a detected supply temperature of the heat pump;

a first predetermined reference value with a difference between the detected return liquid temperature and the detected supply temperature;

a second predetermined reference value with a detected primary volume flow;

a third predetermined reference value with a detected pressure in the heat pump system;

a fourth predetermined reference value with a detected primary temperature;

a fifth predetermined reference value with a difference between the detected inlet and outlet temperature of the primary side.

14. A computer program product, comprising instructions which, when the program is executed by a computer, cause the computer to perform the steps of the method according to claim 1.

15. A system for monitoring a heat pump comprising:

a reference data providing unit configured to provide reference data that includes a minimum length of a heat pump operating interval and a minimum length of a heat pump operation stoppage;

a detection unit configured to detect a heat pump running time that includes a duration of an operating interval of the heat pump as an operating interval length and a duration of an operation stoppage of the heat pump as a stoppage interval length;

a comparison unit configured to compare the heat pump running time with the reference data by comparing the minimum length of the heat pump operating interval with the operating interval length and comparing the minimum length of the heat pump operation stoppage with the stoppage interval length;

a monitoring result determination unit configured to determine a monitoring result depending on the comparison result of the heat pump running time with the reference data; and an output unit configured to output an error message depending on the monitoring result and optionally depending on one or more comparison results, and to output a signal for performing a control intervention in a control method of the heat pump depending on the monitoring result.

* * * * *